US006345827B1

(12) United States Patent
Benoit

(10) Patent No.: US 6,345,827 B1
(45) **Date of Patent: *Feb. 12, 2002**

(54) REINFORCED FRAME FOR A SKATE

(75) Inventor: Louis Benoit, La Balme de Sillingy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/732,747

(22) Filed: Dec. 11, 2000

Related U.S. Application Data

(63) Continuation of application No. 09/147,022, filed as application No. PCT/FR97/00441 on Mar. 12, 1997.

(30) Foreign Application Priority Data

Mar. 14, 1996 (FR) ..... 96 03364

(51) Int. Cl.[7] ..... A63C 17/06

(52) U.S. Cl. ..... 280/11.221; 280/11.231; 280/11.27

(58) Field of Search ..... 280/11.19, 11.22, 280/11.23, 11.27, 11.28, 11.221, 11.231

(56) References Cited

U.S. PATENT DOCUMENTS

| | | | | |
|---|---|---|---|---|
| 3,086,787 | A | 4/1963 | Wyche | 280/11.19 |
| 3,756,614 | A | 9/1973 | Grubin | 280/11.22 |
| 5,332,242 | A | 7/1994 | Cann et al. | 280/11.18 |
| 5,388,846 | A | 2/1995 | Gierveld | 280/11.22 |
| 5,411,278 | A | 5/1995 | Wittmann | 280/11.22 |
| 5,413,380 | A | 5/1995 | Fernandez | 280/11.19 |
| 5,474,310 | A | 12/1995 | Chen | 280/11.22 |
| 5,484,148 | A | 1/1996 | Olivieri | 280/11.18 |
| 5,533,740 | A | 7/1996 | Lin | 280/11.2 |
| 5,580,070 | A | 12/1996 | Bekessy | 280/11.27 |
| 5,720,488 | A | 2/1998 | Foffano et al. | 280/11.22 |
| 5,765,841 | A | 6/1998 | Johnson et al. | 280/11.22 |
| 5,797,610 | A | 8/1998 | Grande et al. | 280/11.22 |
| 5,799,955 | A | 9/1998 | Iverson | 280/11.22 |
| 5,803,466 | A | 9/1998 | Wrike | 280/7.13 |
| 5,803,469 | A | 9/1998 | Yoham | 280/11.27 |
| 5,915,703 | A | 6/1999 | Wrike | 280/11.22 |
| 5,934,693 | A | 8/1999 | Nicoletti | 280/11.22 |
| 6,019,377 | A | 2/2000 | Chiu et al. | 280/11.19 |
| 6,042,124 | A | 3/2000 | Cheatham et al. | 280/11.22 |
| 6,045,143 | A | 4/2000 | Wrike | 280/11.22 |
| 6,047,972 | A | 4/2000 | Rudolph | 280/11.19 |

FOREIGN PATENT DOCUMENTS

| | | |
|---|---|---|
| DE | 1033569 | 7/1958 |
| EP | 0774282 | 5/1997 |
| FR | 2679781 | 2/1993 |

*Primary Examiner*—Michael Mar
(74) *Attorney, Agent, or Firm*—Greenblum & Bernstein, P.L.C.

(57) ABSTRACT

A frame for skates and the like with a structure that includes at least one bearing surface engageable by a boot or the like, and a side flange. One of more ground-engaging members are to be attached to the frame. The components of the structure of the frame are made of at least two at least partially mutually assembled materials having different mechanical properties.

32 Claims, 5 Drawing Sheets

REINFORCED FRAME FOR A SKATE

CROSS-REFERENCE TO RELATED APPLICATIONS

This application is a continuation of Application Ser. No. 09/147,022, which is the U.S. National Phase of PCT/FR97/00441, filed on Mar. 12, 1997, not having been published in English, the disclosure of U.S. patent application Ser. No. 09/147,022 hereby incorporated-by-reference thereto in its entirety and the priority of which is claimed under 35 U.S.C. §120.

This application is also based upon French application No. 96 03364, filed Mar. 14, 1996, the disclosure of which is hereby incorporated by reference thereto in its entirety and priority of which is hereby claimed under 35 U.S.C. §119.

BACKGROUND OF THE INVENTION

1. Field of the Invention

The present application relates to a frame for gliding sport articles such as roller skates and ice skates.

2. Description of Background and Relevant Information

A frame of the aforementioned type is adapted for the connection between one or more gliding members themselves (namely the ice skate blade, wheels or rollers) and the user's foot, the frame being inserted therebetween.

Frames of this type are therefore generally constituted by a bearing surface capable of receiving the skater's boot or shoe, and by one or two longitudinal lateral flanges adapted to receive the wheels, rollers, or the skate blade.

They must also have substantial mechanical resistance characteristics, while being as light as possible, in order to minimize the physical exertion by the skater during use of such skates.

Furthermore, the advanced technology in these gliding sport articles, especially in the case of in-line roller skates, further increases the requirements, which must be met by the skate frames, and which must reach a compromise among the following:

- an increased mechanical resistance and stability, especially for speed skates, but also for the so-called "free ride", "free style", or "hockey" skates, in order to offer efficiency and an unquestionable response in the transmission of movements to the skate by the skater;
- a certain flexibility, especially in certain zones of the skate to allow for an adaptation of the shape of the skate to the path taken, especially on curves at high speeds, but also the dampening of shocks and vibrations; and
- as light in weight as possible.

Furthermore, it is known that the front wheels are the first to receive the ground impacts, whereas the rear wheels transmit the most power.

Currently known techniques for manufacturing frames do not meet all these requirements while maintaining a reasonable manufacturing cost.

Indeed, the oldest manufacturing technique consists of making such frames from sheet metal, bent in a U-shape, as disclosed in the German Patent Publication No. 10 33 569, for example.

Such a construction method, although inexpensive, however, does not permit the manufacture of frames with great mechanical resistance except by substantially increasing the thickness of the sheet metal and therefore its weight, and it permits the creation of a certain flexibility in selected areas even less.

Another commonly used technique consists of making the frames entirely by molding from synthetic or even metallic materials. The integral molding offers the advantage of allowing sufficiently varied forms, but furthermore presents numerous disadvantages, the main disadvantage being the impossibility of the compromise sought and cited previously, for even if the constitutive material of the frame has characteristics of stiffness, it cannot offer at the same time characteristics of flexibility, except by providing zones that are more or less thick according to their function, but this would lead to molds having a burdensome design because of its complexity.

In this field, frames made from composite fibers are also known. Such frames can actually be made in almost any shape possible, but their construction is extremely expensive and difficult to industrialize. Moreover, such frames are certainly very stiff but lack flexibility and are therefore fragile and uncomfortable.

Finally, U.S. Pat. No. 5,388,846 discloses the manufacture of a frame for an ice skate or a roller skate from a sectioned metallic bar whose transverse section corresponds to the general section desired for the frame, the final shape of the frame being obtained after machining with removal of material.

Such a construction method is again very expensive, given the machining time necessary and the quantity of material that must be removed. In addition, it does not allow great freedom with respect to the shape or profile of the frame, nor in seeking the mentioned compromise.

U.S. Pat. No. 3,086,767 relates to a roller skate with an adjustable length whose stability and stiffness are ensured regardless of the number of rollers and the distance separating the front and rear rollers. The skate includes a support plate bent in an inverted U-shape, preferably made of fairly thin steel on which elements are slidably mounted for maintaining the heel and tip of the foot. To each of the side portions of the support plate, there is welded or screwed a downwardly extending metal plate, preferably made of hardened steel and extending the full length of the skate.

SUMMARY OF THE INVENTION

An object of the present invention is to overcome the aforementioned drawbacks and to provide an improved frame for gliding sport articles which enable the resolution of the various problems previously mentioned and, in particular, which combines the characteristics of mechanical resistance, adaptability, construction flexibility, lightness, and low manufacturing costs.

This object is achieved with the frame according to the invention, which comprises at least one bearing surface adapted to receive a shoe and at least one lateral flange provided with means for attaching at least one gliding member, wherein at least one portion is made of plastic that, at least partially, covers a reinforcement having mechanical characteristics different from the plastic portion.

BRIEF DESCRIPTION OF THE DRAWINGS

The invention will be better understood and other characteristics thereof will be shown with the following description, with reference to the attached schematic drawings representing, by way of non-limiting examples, several frame embodiments, and in which.

DETAILED DESCRIPTION OF THE INVENTION

Figure 1:
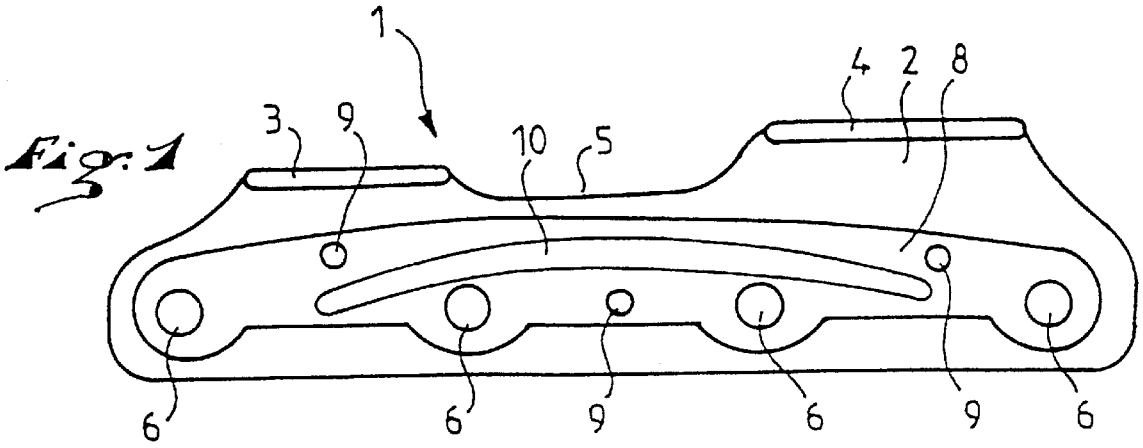
FIG. 1 is a side view of a reinforced frame generally represented according to an example of the invention.

As shown in FIG, 1, the frame 1 according to the invention is made at least in part of plastic and is generally presented in the form of two lateral flanges 2 connected together by two platforms 3 and 4, or foot-bearing members or portions, which give the assembly a substantially U-shaped transverse section. The front member 3 can be regarded as a toe plate or toe platform, and the rear member 4 can be regarded as a heel plate or heel platform.

Each of these platforms 3 and 4 constitutes a bearing surface capable of receiving the athlete's shoe, or supporting the athlete's foot, the shoe (not shown) being attached by any known means, especially glue, rivets, screws, etc., but it can also be attached in a removable manner by non-permanent connecting means.

It is also noted that the platforms 3 and 4 are distinct and separated from each other by a cutout 5, and are positioned at different levels of height, the platform 4 being higher than the platform 3, to take into account the natural position of the athlete, the heel being slightly elevated. Alternatively, they could be positioned at the same height.

Each flange 2 has a straight elongated form, but it can also be slightly bent in an arc of a circle in the longitudinal direction.

At the lower end of each flange, holes 6 are provided for attaching rollers, or as the case may be, a skate blade.

Each hole 6 is made in a cylindrical boss 7 capable of being formed by die casting, boring, etc. The holes 6 positioned correspondingly in the two flanges 2 are coaxial.

According to the invention, the constituent parts of the previously mentioned structure constituting the frame 1, namely the bearing surface 3 and 4 and the flanges 2, are made from at least two materials of different mechanical characteristics, at least partially attached onto or into one another.

In this case, but in a non-limiting way, it is the flanges 2 which, at least in part, are made of a material different from the rest of the structure.

Indeed, the invention can relate to other parts of the frame as described below.

Figure 2:
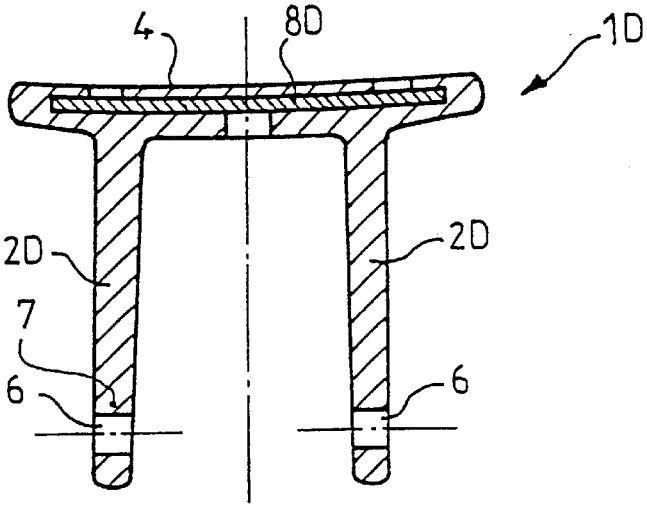
FIGS. 2–6 are transverse cross-sectional views of a frame according to different embodiments.

In the example of FIGS. 1 and 2, the lateral flanges 2 are parallel with respect to one another to form a "U" with the bearing surfaces 3 and 4 and are made of the same material as the bearing surfaces, but they are doubled by external reinforcements 8 made of a different material capable of modifying the mechanical characteristics of the assembly thus obtained.

For example, the reinforcements 8 are metallic, whereas the remainder of the structure is made by molding a plastic material, but it is also contemplated that the reinforcements 8 can be made from a plastic material with predetermined mechanical characteristics, whereas the remainder of the structure is also made from a plastic material with different characteristics.

The metallic reinforcements 8 are obtained by cutting and stamping, and they are then attached to the flanges 2 by any means. As will be seen in the respective figures of the drawings of exemplary embodiments, the reinforcements are effectively maintained in respective recesses, or cavities, of the flanges.

According to the invention, the metallic reinforcements 8 are attached to the flanges 2 by molding when the latter are molded.

Such reinforcements 8 also have the advantage of comprising, at their lower ends, the bored and threaded boss 7, to allow attaching, without any intermediate piece, of the gliding members on a stiff metallic zone, or further on hard plastic where the reinforcements 8 would be made of a loaded plastic rather than a flexible plastic constituting the rest of the structure.

Advantageously, the metallic reinforcements 8 comprise, in their longitudinal direction, stiffening ribs formed by stamping, extending substantially along the entire length of the flange 2 and having a generally bent shape.

Such a characteristic allows, at equal stiffness, dividing the thickness and therefore the weight of the reinforcement 8 practically in half.

Regardless of the example described hereinafter, an improvement of the torsional and flexional rigidity of the frame is obtained due to the reinforcement elements. These can be arranged between the inside and the outside of the frame so as to optimize the necessary mechanical characteristics thereof. It is also possible to have a reinforcement on one side only of the frame, since it is known that the maximum of the forces transmitted by the skater to the wheels pass through the inside skirt or flange of the frame. That is also why certain examples envision using different materials between the internal flange and the external flange.

In the embodiment example of FIG. 2, the frame 1D comprises bearing members 3, 4 made integrally, or unitarily, with parallel lateral flanges 2D, forming a U with the bearing surfaces, through plastic molding including through molding or co-injection, an internal reinforcement 8D embedded on or in the bearing members 3, 4, and made of a metallic material or a plastic material different from the preceding one. Such a construction is, of course, compatible with the bearing members 3, 4 being positioned at different levels.

Thus, a structure whose bearing member alone is stiffened is obtained, whereas the flanges maintain a certain flexibility.

In the examples of the invention shown in FIGS. 3–7, the frame 1E, 1F, 1G, 1H is generally constituted by a bearing member 3, 4, and two lateral flanges 2E, 2F, 2G, 2H, parallel with respect to one another and forming a U with the bearing member, this structure being obtained by molding a plastic material around at least one reinforcement 8E, 8F, 8G, 8H, made of metal or a plastic material different from the first, arranged inside the flanges, i.e., within recess or cavities thus formed within the flanges by such molding.

Figure 3:
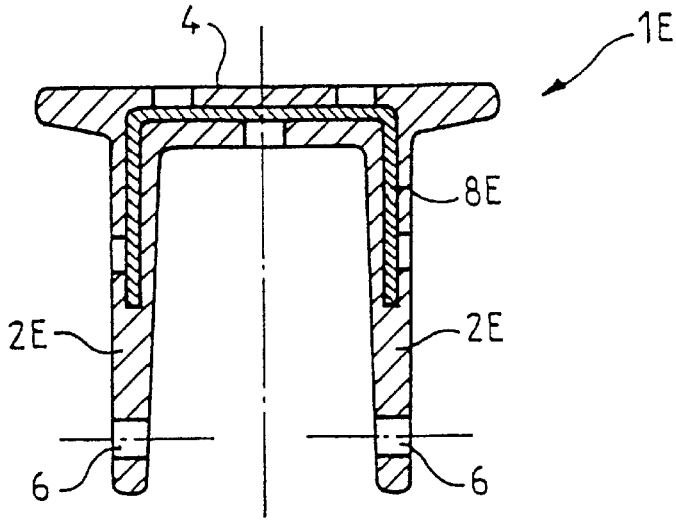

More particularly, according to FIG. 3, the reinforcement 8E forms a U extending, on the one hand, inside the bearing plane 4, and, on the other hand, inside the lateral flanges 2E by their parallel arms, the end of the latter being positioned on this side of the end parts of the flanges 2E which are bored with holes 6 and threaded to ensure the attachment of the gliding members.

Figure 4:
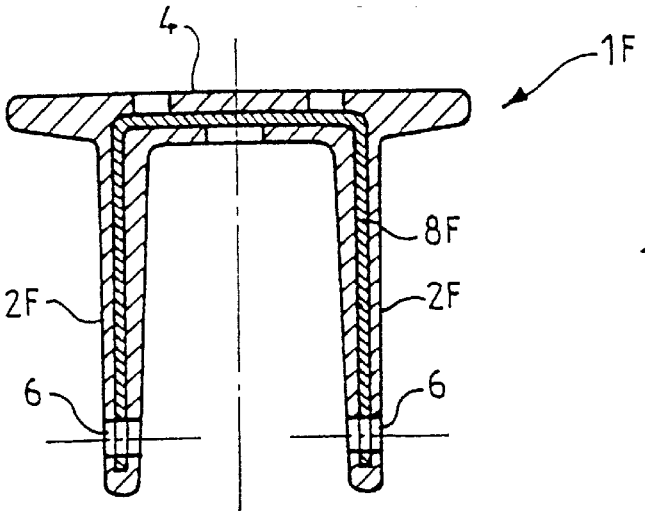

However, according to the alternative embodiment shown in FIG. 4, the reinforcement 8F forms a U extending, on the one hand, inside the bearing plane 4, and, on the other hand, inside the lateral flanges 2F by their parallel arms, the end of the latter extending beyond the end parts of the flanges 2F which are bored with holes 6 and threaded to ensure the attachment of the gliding members. This last solution offers the advantage of creating reinforcements at the level of the holes 6.

Figure 5:
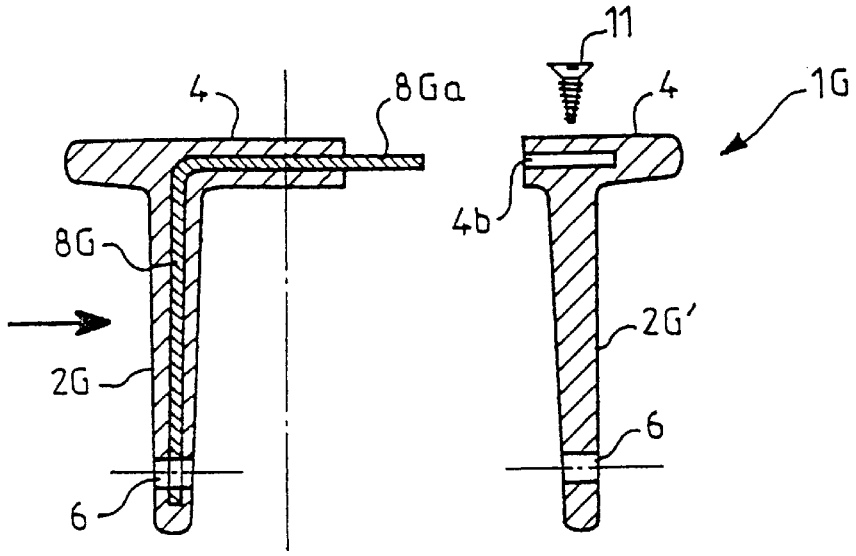

According to the example of FIG. 5, the frame 1G is constituted of two parts, the first part integrating a reinforcement 8G molded in a portion of the bearing member 4 and a flange 2G, generally perpendicular to the portion of the bearing member 4, the second part comprising a complementary portion of the bearing member 4 and a second flange 2G' with no reinforcement, means for connecting the two parts 2G, 2G' of the frame 1G being arranged at the level of the bearing member 4.

The means for connecting these two frame parts are constituted by an extension 8G*a* of the reinforcement 8G of the first frame part extending beyond its part of the bearing member 4 so as to exit freely therefrom in order to cooperate with a corresponding housing 4*b* provided in the other portion of the bearing member 4 of the second part of the frame 1G.

The immobilization of the reinforcement part 8G*a* in the housing 4*b* is done by any means, in this case by a screw 11. The advantage of such an embodiment is that the frame can be made more simply in two parts and that the assembly of these two parts can easily be obtained by inserting one of the parts.

Figure 6:
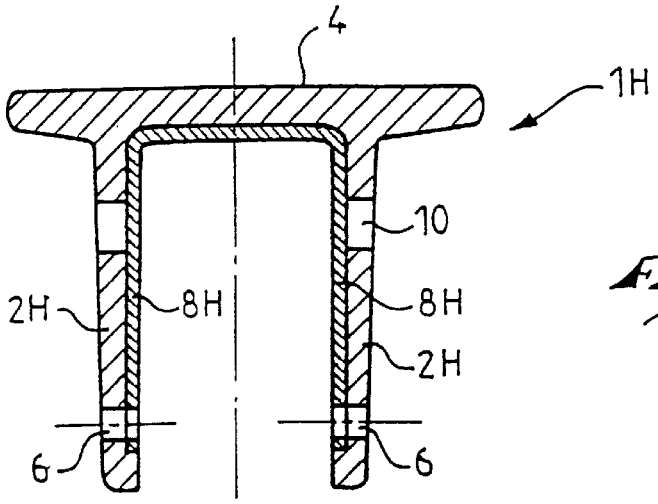
Figure 7:
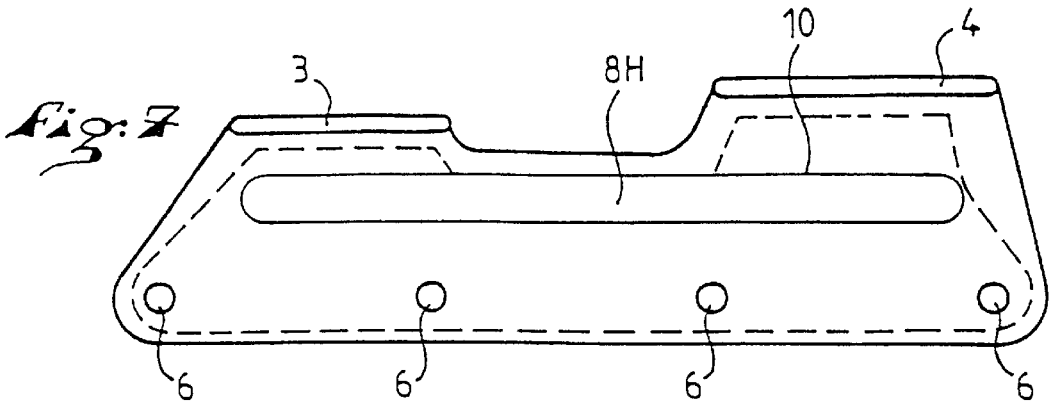
FIG. 7 is a side view of a frame made according to the embodiment of FIG. 6.

In the frame 1H, according to the example of FIG. 6, the reinforcement 8H forms a U extending in an apparent way on the internal surfaces of the U formed by the parallel arms of the flanges 2H, and by the bearing plane 4 connecting them.

According to this same example, at least one of the lateral flanges 2H comprises a longitudinal window 10 for displaying the reinforcement 8H.

It is noted that the reinforcements can also be made of composite materials (glass fibers, carbon fibers, etc.).

Figure 8:
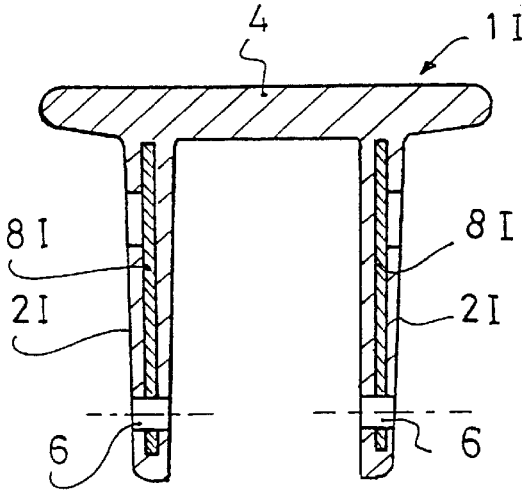
FIGS. 8–15 are transverse cross-sectional views according to other embodiments.

In the example of FIG. 8, the frame 11 comprises reinforcements 8I constituted by two distinct planar elements extending inside the lateral flanges 2I and whose ends extend beyond the end portions of the flanges pierced with holes 6.

Figure 9:
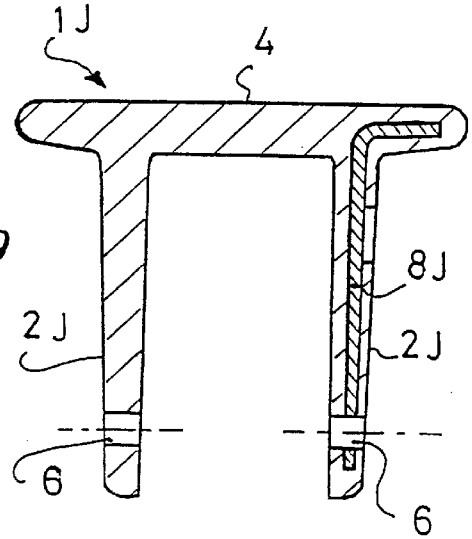

According to the example of FIG. 9, the frame 1J comprises a reinforcement 8J constituted by a single planar element extending inside a single lateral flange 2J and whose upper end is bent perpendicularly towards the outside to locally reinforce the bearing plane defined by members 3, 4, and whose lower end extends beyond the end portion of the flange 2J pierced with a hole 6.

It is noted that the essential difference between the example of FIG. 9 and FIG. 8 lies in the asymmetry of that of FIG. 9. However, in the two cases, the reinforcements 8I and 8J are metallic, whereas the rest of the structure, and especially the flanges 2I and 2J, are plastic.

Figure 10:
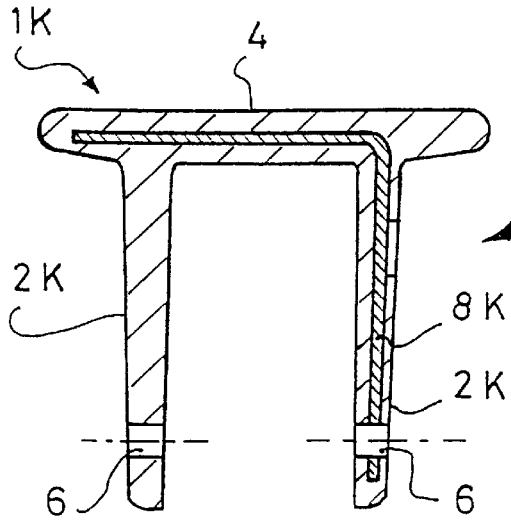

According to the example of FIG. 10, the frame 1K comprises a reinforcement 8K constituted by an orthogonal element, one end of which extends inside one of the flanges 2K, beyond its end part pierced with holes 6, and another part extends inside the bearing member 3, 4. Also, in this case, the reinforcement 8K is metal, whereas the rest of the structure is plastic.

Figure 11:
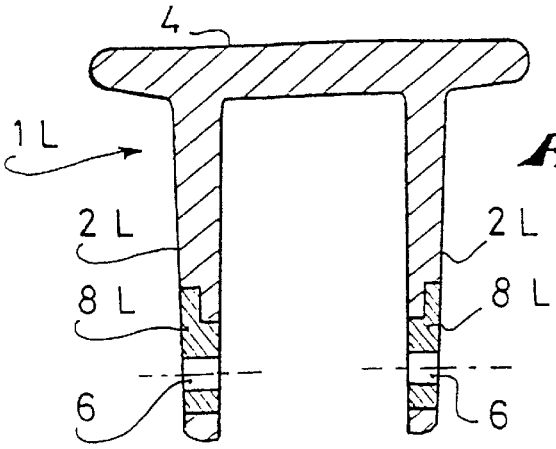

According to the example of FIG. 11, the frame 1L comprises reinforcements 8L constituted by two distinct elements extending inside the flanges on either side of the end holes 6 of the flanges 2L. In this case, the reinforcements 8L are made of hard plastic, whereas the rest of the structure is made of more flexible plastic. They can also be metallic.

Figure 12:
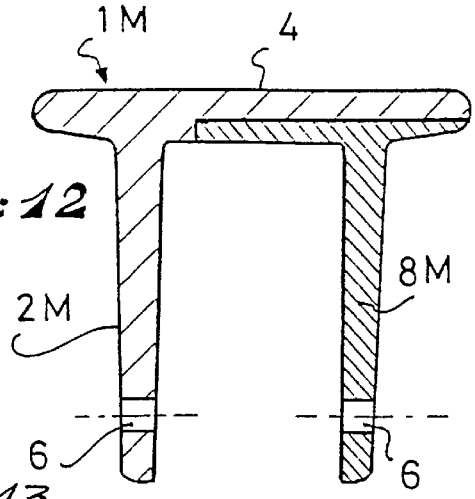

According to the example of FIG. 12, the frame 1M comprises a reinforcement 8M, itself constituting one of the structure flanges, and extending perpendicularly to constitute a lower part of the bearing plane defined by the upper surfaces of bearing members 3, 4, cooperating with an upper part of the same plane which extends perpendicularly to constitute the other flange, the structure being made by co-injection of two different plastic materials. In this case, the reinforcement 8M constituting one of the flanges is made of a relatively rigid plastic, and the rest of the structure is made of a more flexible plastic.

Figure 13:
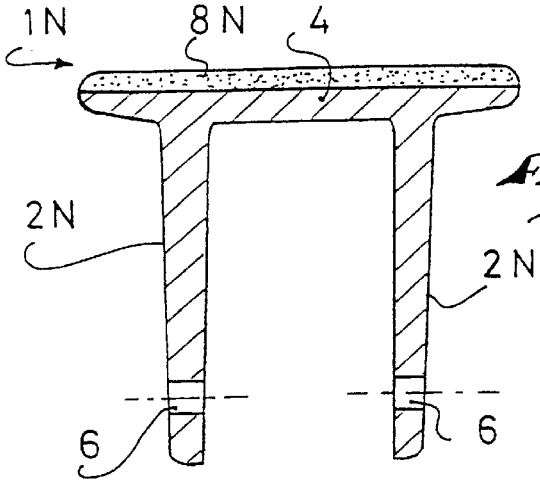

According to the example of FIG. 13, the frame 1N differs essentially from the preceding ones in that the flanges 2N are made of a rigid plastic material that does not require a reinforcement, but a flexible dampening part 8N is made of a "foamed" plastic layer and molded onto the bearing plane 3, 4 of the structure.

Figure 14:
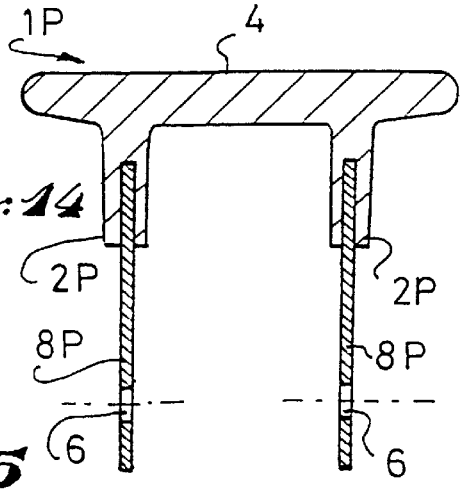

According to the example of FIG. 14, the frame 1P comprises reinforcements 8P constituted by two distinct elements extending partly inside shortened flanges 2P, i.e., within respective downwardly open cavities or recesses, and partly outside the shortened flanges. As can be seen in FIG. 14, the lower portions of the reinforcements 8P, outside the sub-flanges, include the holes 6. In this embodiment, the reinforcements 8P are metallic, whereas the remainder of the structure is plastic. Also, each of the shortened flanges can be regarded as a "base part" of a flange, whereas the flanges themselves of the frame 1P are constituted by both the plastic base parts 2P and the reinforcements 8P. In fact, in the descriptions of all of the embodiments in which a flange includes a distinct downwardly depending part that is reinforced with a reinforcement, the use of the term "flange" can be understood to refer to a base part, since the reinforcement can be considered to be part of such flange. For example, in FIG. 8, each of the flanges 2I can be regarded as a base part, which is reinforced with a reinforcement 8I. In FIG. 9, the left flange 2J is not reinforced and, therefore, such non-reinforced downwardly depending part 2J entirely comprises the left flange. Nevertheless, it can be properly character as being "at least" a base part of a flange, i.e., the entire flange.

Figure 15:
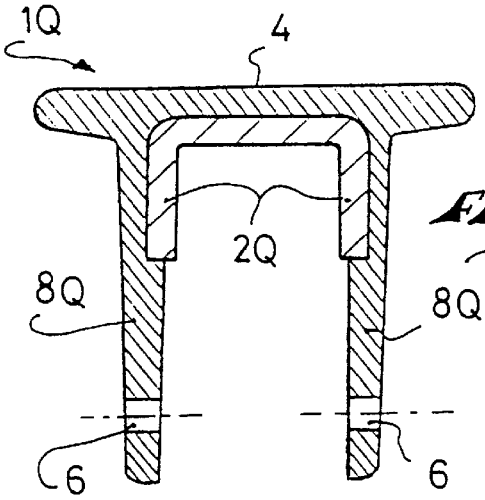

According to the example of FIG. 15, the frame 1Q comprises a reinforcement 8Q constituted by a U-shaped element covering the shortened flanges 2Q and the bearing plane 3, 4, and extending beyond the flanges to constitute the end of the latter pierced with holes 6. In this case, the reinforcements 8Q are made of a relatively rigid plastic, whereas the flanges 2Q and the bearing member 4 are made of a more flexible plastic.

According to another essential characteristic of the invention, the reinforcements 8, according to all the previously described examples, extend, as needed, in a variable way, along the transverse axis and/or longitudinal axis of the structure.

Figure 16:
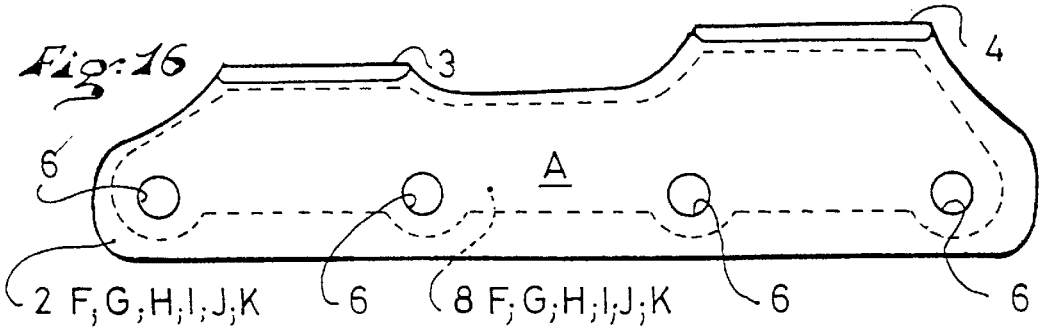
FIGS. 16–20 are longitudinal views of a frame according to alternative embodiments.

Thus, according to the example of FIG. 16, the flanges 2F, 2G, 2H, 2I, 2J, 2K are provided with at least one lateral reinforcement 8F, 8G, 8H, 8I, 8J, 8K constituting a zone A and extending partially into one corresponding flange along the longitudinal axis, so as to reinforce the structure in the area of at least one hole 6 of the wheel. In this case, this lateral reinforcement extends over the quasi-totality of the flange and all of the holes 6.

Figure 17:
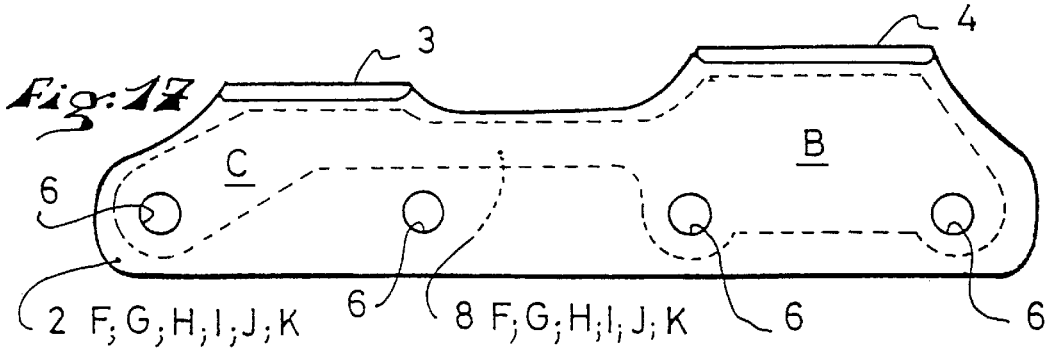

However, according to the example of FIG. 17, which in fact shows two possible examples, at least one lateral reinforcement B and C extends partially into one corresponding flange along the longitudinal axis, so as to reinforce the structure at the level of at least one hole 6 of a wheel. It is noted that in the case of a reinforcement covering a zone B, the latter reinforces a corresponding zone covering two holes 6, whereas according to another case illustrated by a reinforcement which would be constituted by the zones B and C, the reinforcement would reinforce the structure in the corresponding zones, but also at the level of three of the holes 6 of the wheels.

Figure 18:
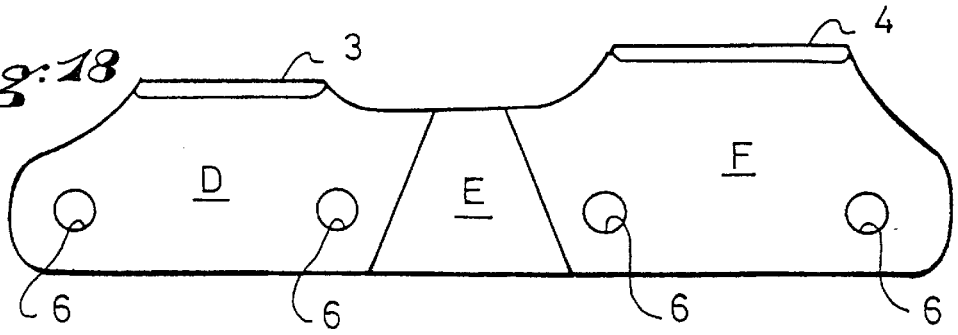

According to the example of FIG. 18, two rigid reinforcements D, F are integrated in at least one of the flanges, reinforcing the structure in the area of the wheels and separated in the longitudinal direction by a complementary intermediate element E made of a relatively flexible material constituting an elastically deformable zone of the frame extending over its whole height.

Figure 19:
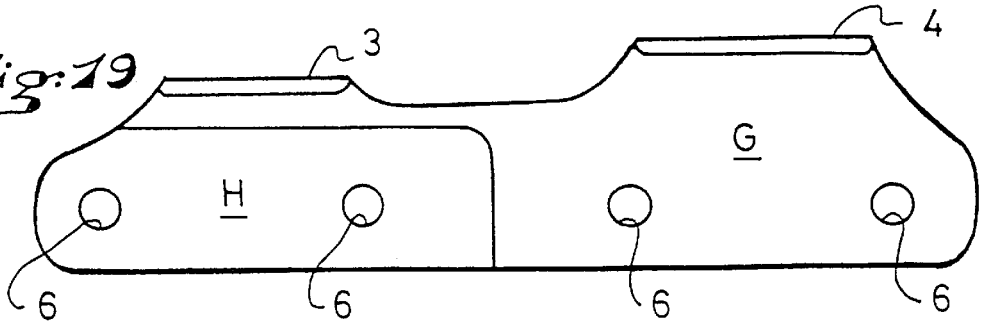

According to the example of FIG. 19, a rigid reinforcement G is integrated in at least one of the flanges, reinforcing the structure towards the rear and extending beyond the ends of the flanges pierced with holes and generally constituting the bearing plane 3, 4, a complementary end element H made of a more flexible material constituting the front of the structure and also extending beyond the end holes of the flanges.

Figure 20:
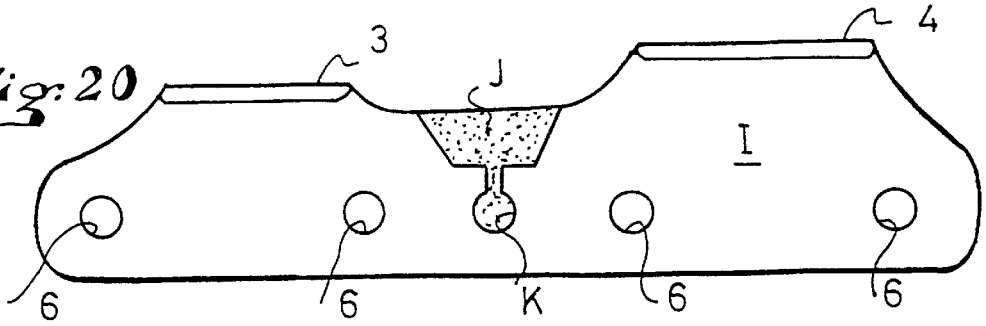

According to a last embodiment example shown in FIG. 20, a reinforcement I made of a relatively rigid material is integrated in at least one of the flanges, and has an upper cutout in which, in the longitudinal direction, a complementary intermediate element J made of a relatively flexible material is integrated, which constitutes an elastically deformable zone extending in a corresponding upper zone of the frame. The reinforcement I and the complementary intermediate element J will not necessarily be made of different materials. In this example, several intermediate elements distributed longitudinally over the frame can also be envisioned.

The rigid reinforcement I comprises at the lower end of the cutout, in which the soft element J is integrated, a recess K constituting a flexion zone of the frame.

The invention is intended to encompass all combinations of materials, regardless of the previously described examples. Likewise, the invention is intended to encompassed the distribution of different materials, as much in the longitudinal direction as in the transverse direction.

What is claimed is:

1. An in-line roller skate frame comprising;

a front foot-bearing portion and a rear foot-bearing portion, said front and rear foot-bearing portions being made unitarily;

lateral flanges spaced apart a distance to accommodate attachment of a plurality of in-line rollers, said lateral flanges extending downwardly from said front and rear foot-bearing portions, each of said lateral flanges comprising at least a base part depending downwardly from said front and rear foot-bearing portions and at least one of said lateral flanges further comprising a reinforcement, at least said one of said lateral flanges further comprising a downwardly extending recess within said base part with at least a part of said reinforcement being fastened within said recess;

said reinforcement being made of a material having different mechanical characteristics relative to said base parts of said lateral flanges, said reinforcement extending downwardly to a lower end; and holes extending within said flanges for attachment of rollers, said lower end of said reinforcement including at least one of said holes.

2. An in-liner roller skate frame to claim 1, wherein:

each of said downwardly extending recess comprises a downwardly open recess, a portion of each of said reinforcements being positioned within and extending downwardly from respective ones of said recesses.

3. An in-line roller skate frame according to claim 1, wherein:

said at least one reinforcement comprises two distinct reinforcements, each of said two reinforcements extending partly inside said base part of respective ones of said flanges and partly outside said base part of said respective ones of said flanges to form lower ends of said flanges, said end of said flanges having said holes, said holes extending through said reinforcements.

4. An in-line roller frame according to claim 2, wherein:

said at least one reinforcement comprises two distinct reinforcements, each of said two reinforcements extending party inside said base part of respective ones of said flanges and partly outside said base part of said respective ones of said flanges to form lower ends of said flanges, each of reinforcements consisting of generally vertically extending members.

5. An in-line roller skate frame according to claim 1, wherein:

each of said front and rear foot-bearing portions comprises a bearing surface adapted to support a shoe.

6. An in-line roller skate frame according to claim 1, wherein:

said reinforcement is metallic, said reinforcement being made by cutting and stamping.

7. An in-line roller skate frame according to claim 1, wherein:

said reinforcement comprises at least one stiffening rib.

8. An in-line roller skate frame according to claim 7, wherein:

said stiffening rib has a longitudinally extending curved shape.

9. An in-line roller skate frame according to claim 8, wherein:

said longitudinally extending curved stiffening rib extends substantially an entirety of a length of the frame.

10. An in-line roller skate frame according to claim 1, wherein:

said lateral flanges comprises a pair of lateral flanges, each of said lateral flanges comprising a base part and a reinforcement.

11. An in-line roller skate frame frame according to claim 10, wherein:

said reinforcements extend only in a substantially vertical direction.

12. An in-line roller skate frame according to claim 10, wherein:

said reinforcements do not extend laterally beyond of either of said flanges.

13. An in-line roller skate frame according to claim 10, wherein:

said reinforcements reinforce only said base parts of said flanges.

14. An in-line roller skate frame according to claim 1, wherein:

said reinforcement reinforces only said base part of said at least one of said lateral flanges, said reinforcement not reinforcing either of said front and rear foot-bearing portions.

15. An in-line roller skate frame according to claim 1, wherein:

at least said base parts are made of plastic, and said reinforcements are made of metal.

16. An in-line roller skate frame according to claim 1, wherein:

said lateral flanges comprise a pair of lateral flanges, each of said lateral flanges comprising a respective reinforcement, said reinforcements being received and retained within respective ones of said recesses by being molded therein.

17. An in-line roller skate frame according to claim 1, wherein:

said lateral flanges comprise a pair of lateral flanges, each of said lateral flanges comprising a respective reinforcement, said reinforcements being received and retained within respective ones of said recesses by being molded therein.

18. An in-line roller skate frame according to claim 1, wherein:

said lateral flanges comprise a pair of parallel lateral flanges, said front and rear foot-bearing portions being formed unitarily with said parallel lateral flanges, said parallel lateral flanges and said front and rear foot-bearing portions forming a U-shape by molding of a plastic material, covering said reinforcement by molding or co-injection, said reinforcement being embedded onto or into said front and rear foot-bearing portions.

19. An in-line skate frame according to claim 1, wherein:

said lateral flanges comprise a pair of parallel lateral flanges, said parallel lateral flanges and said front and rear foot-bearing portions forming a U-shape, said pair of parallel lateral flanges and said front and rear foot-bearing portions being obtained by molding or co-injection of a plastic around said reinforcement, said reinforcement being arranged inside or outside said flanges.

20. An in-line roller skate frame according to claim 19, wherein:

said, reinforcement comprises two distinct planar elements extending inside said lateral flanges, said planar elements having ends extending beyond end parts of said lateral flanges pierced with holes, said holes comprising said holes for attachment of rollers.

21. An in-line roller skate frame according to claim 19, wherein:

said reinforcement is constituted by a single planar element extending inside a single one of said lateral flanges, said single pillar element having an upper end bent perpendicularly towards the outside of the frame to locally reinforce said bearing surface, said single planar element having a lower end extending beyond an end part of said flange pierced with a hole.

22. An in-line roller skate frame according to claim 19, wherein:

said reinforcement is constituted by an orthogonal element, one portion of said orthogonal element extending inside one of said lateral flanges, beyond an end part pierced with a hole, and a second portion of said orthogonal element extending and ending inside said front and rear bearing portions.

23. An in-line roller skate frame according to claim 1, wherein:

each of said front and rear foot-bearing portions, together with said parallel lateral flanges forms a U-shape;

said reinforcement comprises two distinct elements extending inside respective ones of said lateral flanges, on upper and lower sides of said holes of said lateral flanges.

24. An in-line roller skate frame according to claim 1, wherein:

said reinforcement extends variably transversely and/or longitudinally of the frame.

25. An in-line roller skate frame according to claim 24, wherein:

said reinforcement extends longitudinally partially along a corresponding one of said at least one lateral flange, so as to reinforce the frame at at least one of said holes.

26. An in-line roller skate frame according to claim 24, wherein:

each of said front and rear foot-bearing portions and said parallel lateral flanges form a U-shape;

said reinforcement comprises, in said at least one of said lateral flanges, two rigid integrated reinforcements, reinforcing the frame in an area of said holes, said two rigid integrated reinforcements being separated longitudinally by a complementary intermediate element made of a relatively flexible material constituting an elastically deformable zone of the frame extending over an entirety of a height of the frame.

27. An in-line roller skate frame according to claim 24, wherein:

each of said front and rear foot-bearing portions and said parallel lateral flanges form a U-shape;

said reinforcement comprises, in said at least one of said lateral flanges, a rigid integrated reinforcement, reinforcing the frame in a rear portion of the frame and extending beyond ends of said holes of said lateral flanges and generally constituting said bearing member, a complementary end element made of a more flexible material constituting a front of the frame and also extending beyond said end holes of said lateral flanges.

28. An in-line roller skate frame according to claim 24, wherein:

each of said front and rear foot-bearing portions and said parallel lateral flanges form a U-shape;

said reinforcement comprises a reinforcement made of a relatively rigid material and integrated in said at least one of said lateral flanges, said reinforcement having at least one upper cutout, a complementary intermediate element made of a relatively flexible material being longitudinally integrated in the frame, said intermediate element constituting an elastically deformable zone extending in a corresponding upper zone of the frame.

29. An in-line roller skate frame according to claim 28, wherein:

said reinforcement comprises, at a lower part of said cutout, a recess constituting a flexion zone of the frame.

30. An in-line roller skate frame according to claim 1, wherein:

at least one of said lateral flanges comprises a longitudinal window for extending from an outer surface of said one of said lateral flanges to said reinforcement for viewing said reinforcement.

31. An in-line roller skate frame according to claim 1, wherein:

said reinforcement extends longitudinally vertically beneath both of said front and rear foot-bearing portions.

32. An in-line roller skate frame according to claim 1, wherein:

said downwardly extending recess within said base part comprises a vertically extending recess.

* * * * *